US005345993A

United States Patent [19]

Hackman

[11] Patent Number: 5,345,993

[45] Date of Patent: Sep. 13, 1994

[54] STRIP FORMING APPARATUS FOR RAPID SOLIDIFICATION

[75] Inventor: Lloyd E. Hackman, Worthington, Ohio

[73] Assignee: Ribbon Technology Corporation, Gahanna, Ohio

[21] Appl. No.: 116,513

[22] Filed: Sep. 7, 1993

Related U.S. Application Data

[63] Continuation of Ser. No. 857,477, Mar. 25, 1992, abandoned.

[51] Int. Cl.[5] ..... B22D 11/06

[52] U.S. Cl. ..... 164/423; 164/429

[58] Field of Search ..... 164/463, 423, 479, 429

[56] References Cited

U.S. PATENT DOCUMENTS 4,930,565 6/1990 Hackman et al. ..... 164/463

FOREIGN PATENT DOCUMENTS 59-13551 1/1984 Japan ..... 164/429

2-104450 4/1990 Japan ..... 164/429

*Primary Examiner*—Kuang Y. Lin

*Attorney, Agent, or Firm*—Frank H. Foster

[57] ABSTRACT

Molten metal dispensed upon the surface of an adjacent rotating drum produces a ribbon of solidified metal which separates from the drum while the drum is rotating. To prevent ripples from forming in the surface of the ribbon, a casting surface on the periphery of the rotating drum includes structure to minimize the ratio of transverse heat flow rate from the casting surface to radial heat flow rate.

5 Claims, 3 Drawing Sheets

STRIP FORMING APPARATUS FOR RAPID SOLIDIFICATION

This is a continuation of application Ser. No. 07/857,477, filed Mar. 25, 1992, now abandoned.

TECHNICAL FIELD

This invention relates to apparatus for forming a metal ribbon or strip by rapid solidification of molten metal applied to a rotating casting surface.

BACKGROUND ART

Apparatus and processes for forming wires, sheets, strips, flakes, etc. by contacting molten metal with a rotating disk or drum are well established in the field and U.S. Pat. Nos. 4,705,095 and 4,813,472 are illustrative of techniques used to achieve the desired result. The terms ribbon, sheet and strip are often used interchangeably.

U.S. Pat. No. 4,705,095 deals with the structure of a casting surface on a rotating drum which is configured to allow relatively fast rotation of the drum for the rapid solidification of a cast metal ribbon sheet. That invention is directed to a knurled surface for the casting area on the rotating drum which prevents air bubbles from being trapped between the molten metal and the casting surface as the drum rotates. U.S. Pat. No. 4,813,472 is directed to melt overflow structures for feeding the molten metal to the cylindrical casting wheel.

A problem exists in the formation of metal strip in the fashion disclosed by these patents and others in the field. The problem is the formation of rippled or wavy edges along the opposite sides of the strip resulting from the rapid freezing process. Often ripples are so acute that the finished product must be passed between pinch rollers to smooth the surface. This is obviously time consuming and expensive. In an attempt to solve this problem, Applicant has theorized the ripples result from differential cooling of the metal transversely across the strip.

Casting drums or wheels used in the rapid solidification industry are traditionally formed to be hollow and within the hollow cavity is water or some other cooling fluid. The cooling fluid serves as a heat sink to draw off heat from the casting surface to keep it at a temperature sufficiently low to freeze the molten metal almost immediately upon contact.

It is accepted heat transfer theory that application of heat at a point on a body results in heat flowing in all directions in the body until the body achieves near uniform temperature. With the rotating casting surface, the edges of the cast metal sheet are believed to cool much faster than the central portion of the strip. Heat from the edge areas of the strip flows through the drum, both radially inwardly toward the water and transversely parallel to the metal cylindrical surface of the drum toward the ends thereof. Conversely, heat extracted from the center region of the strip flows essentially only radially inwardly toward the water in the hollow drum. Along most of the width of the strip being cast, heat conduction is confined principally to radial heat flow through the casting drum with edge effects near the edges where there is a progressively increasing transverse component of heat flow. The result is that the edges freeze first. Then the central portion freezes undergoing the usual contraction during cooling which longitudinally compresses the ribbon, creating residual stresses and compressing the already cooler edges into a wavy pattern.

BRIEF DISCLOSURE OF INVENTION

Based upon the Applicant's above stated theory of cooling and to solve the rippled edge problem outlined above, a redesigned drum for casting strip minimizes transverse heat transfer from the side edges of the metal sheet being cast and thereby decreases the temperature differential transversely across the surface of the solidifying metal sheet. As a result, ripples induced by differential cooling are minimized or eliminated and the need for subsequent pinch rollers is eliminated. The cooling rate of the ribbon is made more uniform and the temperature gradient transversely across the casting surface is reduced by providing means to limit the transverse heat flow in the casting drum relative to the radial heat flow. This is accomplished generally by either increasing the transverse thermal resistance near the edges of the casting surface or decreasing the radial thermal resistance at the central portion of the casting surface.

Looking to the overall combination, a source of molten metal discharges its contents in a uniform layer onto a casting surface of a rotating drum which freezes the molten metal to produce a solid ribbon of metal. The metal separates from the rotating drum at a location remote from the liquid metal dispensing device so that a continuous ribbon of metal is cast on the rotating drum.

Having formed the theory and tested the same, namely that ripples in the finished metal sheet are reduced by reducing the transverse temperature differential across the surface of the solidifying and cooling metal sheet, several embodiments of rotating drums are presented to achieve the desired result. One structure provides for the casting surface itself to be raised above the surface of the rest of the rotating drum. This provides an underlying casting surface which is only as wide as the strip being cast and thereby relatively smaller amounts of heat are transferred transversely of the casting surface. Heat flow is essentially confined to a direction radially into the cooling liquid within the drum and relatively small amounts of heat can flow along the bordering thinner drum ends. Thereby, the temperature gradient transversely from the ribbon and casting surface centerlines to their edges remains relatively small.

A second embodiment involves cutting a pair of grooves circumferentially around the drum located at the side edges of the ribbon or strip being cast. That makes a very narrow heat flow path for heat to flow transversely along the drum surface. Because of the narrow flow path, less heat flows transversely and thereby there is less temperature differential transversely across the casting surface and thereby less cooling rate differential across the ribbon of cooling metal.

A third embodiment includes a ceramic or other low thermal conductivity material as a part of the drum along each edge of the casting surface. Thereby, almost all of the heat must flow radially directly into the liquid within the drum.

Objects of the invention not clear from the above will be understood by a review of the drawings and the description of the preferred embodiments which follow.

Figure 1:
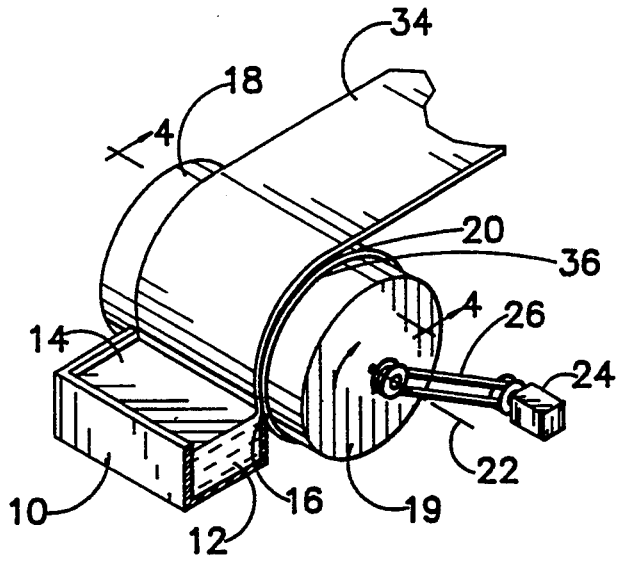
FIG. 1 is a schematic perspective view of the apparatus of this invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

FIG. 1 illustrates a receptacle 10 which is heated in a conventional manner and contains a pool of molten material 12. However, instead of the walls of the container everywhere extending above the upper surface 14 of the molten metal material 12, a portion of the container wall is absent in the region above a generally horizontal edge 16 which is formed at the top of a portion of the wall of the receptacle 10. The edge 16 is lower than the top of the other walls of the receptacle 10 so that the molten material level may be raised sufficiently to overflow the molten material over the edge 16.

In place of the wall which is missing above the edge 16, a peripheral, heat extracting substrate surface 18 of a drum 19 is positioned to receive the overflowing liquid metal. A cylindrical heat extracting casting surface 20 is formed as a part of the peripheral surface 18 and rotates about the drum pivot axis 22. The casting surface 20 is spaced from the edge 16 and is preferably vertically and horizontally adjustable relative to the edge 16 to permit the spacing from the edge to be controllably varied and also to permit adjustment of the angular position on the drum 19 at which the molten material 12 contacts the casting surface 20. The transverse dimension of peripheral surface 18 of the drum is ordinarily greater than the width of molten metal dispensed from edge 16.

A conventional means, such as an electrical motor 24 and a connecting drive means 26, are provided for driving the casting surface 20 past the region of its contact with the melt 12. In most applications it is driven at a substrate surface speed in the range of 150 to 8000 feet per minute.

Preferably the overflow edge 16 is linear and the casting surface 20 is spaced equidistantly from all points along the edge 16. However, the edge may be contoured and the surface contoured in a mating form to provide contoured products. Further, the spacing of the edge 16 from the casting surface 20 may be varied along the length of the edge 16 and the edge 16 may be angled slightly from perfectly horizontal in order to provide a resulting product of varying thickness and for otherwise varying the characteristics of the products of the invention.

Figure 2:
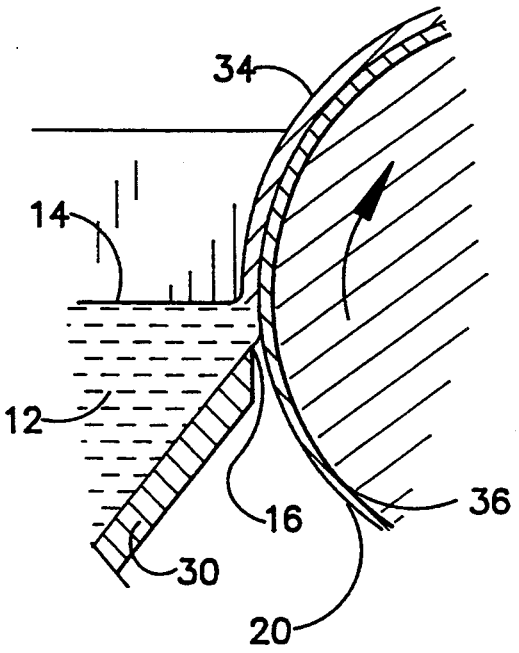
FIG. 2 is a fragmentary sectional view of the spout-liquid metal-rotating drum interface of FIG. 1 with a slightly modified feeding spout.
Figure 3:
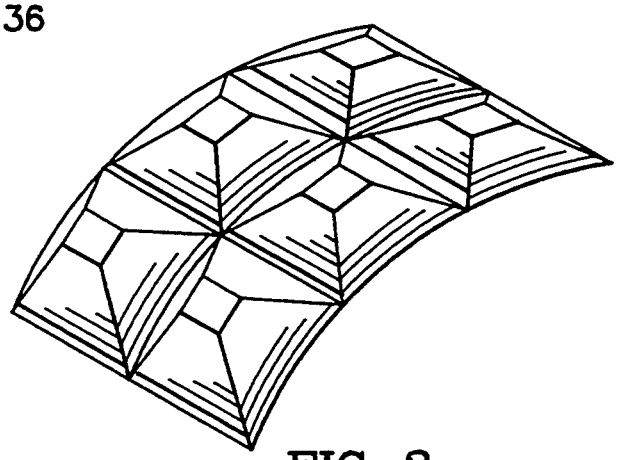
FIG. 3 is an enlarged fragmentary view of one surface area of the casting surface of this invention.

FIG. 2 is a fragmentary sectional view of the molten metal being drawn upward on casting surface 20 on a rotating drum. The shape of the dispensing spout 30 is a different shape from what is illustrated in FIG. 1 and the particular shape is not of significance in this invention. The opening width thereof should not be substantially greater than the width of the casting surface 20, best illustrated in FIG. 4. The casting surface may be knurled, as illustrated in FIG. 3, helically grooved, or have other patterns described in the art. One surface is discussed in U.S. Pat. No. 4,705,095, which is incorporated herein by reference to the extent necessary for a full understanding of the invention. Should the liquid metal dispensed by the spout 30 slop over the edges of the casting surface 20, the result is a distortion of the metal strip and other undesirable features. Accordingly, it is important that the width of the opening of the dispensing spout not be substantially greater than the width of the casting surface. Thereby, the liquid dispensed will not slop over the side edges of the casting surface.

Figure 4:
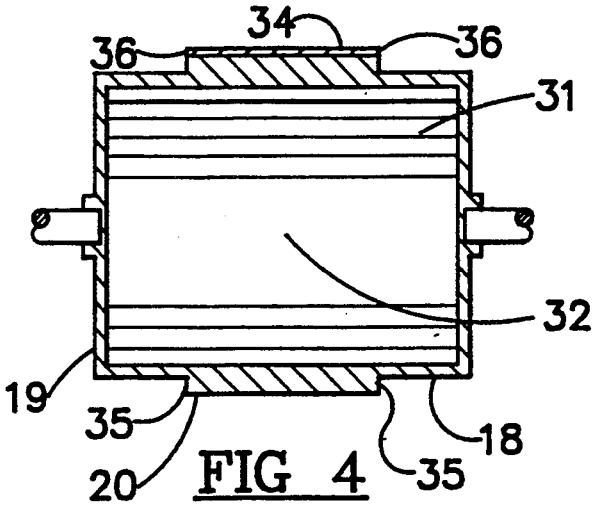
FIG. 4 is a sectional view of the drum of FIG. 1 taken along line 4—4.

Looking to FIG. 4, the drum is illustrated as being hollow, by virtue of an internal chamber 31 filled with a cooling liquid 32, preferably water. The fluid within the chamber 31 of drum 19 may or may not completely fill the drum and may or may not be circulated on a continual basis while the drum is rotating, but it is the purpose of the fluid 32 to extract heat from the casting surface with sufficient rapidity as to freeze the molten metal 12 as it flows from spout 30 onto casting surface 20 to form a solid cast metal sheet or ribbon or strip 34.

The casting surface 20 in FIG. 4 is shown as a raised surface with respect to the remainder of drum peripheral surface 18 and the purpose of the raised surface is to provide a casting surface 20 as a heat sink to absorb heat from the metal strip 34 in relatively rapid fashion and to maintain a relatively uniform temperature transversely across the sheet during its cooling process. A casting surface of relatively uniform temperature insures a metal sheet 34 of relatively uniform temperature transversely across its width.

The raised surface creates shoulders 35 on the lateral sides of the casting surface 20 which are contacted by air, which has a high thermal resistance. Consequently, heat flow at the edges of the casting surface 20 must be predominantly radial, as it is at the central portion of the casting surface 20. As a result, the side edges 36 of the strip 34 cool at about the same rate as the remainder of the strip. The shoulders 35 of casting surface 20 may be slightly lower in temperature at all times than the central portion of the casting surface 20 in contact with metal strip 34, but the temperature differential is greatly reduced as compared to a casting strip having substantially the same thickness as the remainder of the drum surface 18.

Figure 5:
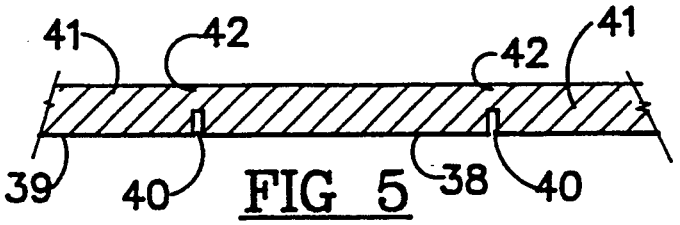
FIG. 5 is a fragmentary sectional view of an alternative embodiment of the casting strip of FIG. 4.

FIG. 5 illustrates an alternative embodiment to the drum surface 18 illustrated in FIG. 4. In this embodiment a casting surface 38 and the remaining drum surface 39 have substantially the same internal and external radii, but the structure used to minimize heat flow transversely from the casting surface to the remainder of the drum surface 18 is a pair of grooves 40 cut circumferentially around the drum surface at the edges of the casting surface 38. Because of the air gap created by the grooves 40, the thermal resistance of the heat flow paths 42 from the casting surface 38 to the laterally transverse drum portion 41 is greatly increased, which reduces transverse heat flow. Again, the object of the invention is achieved, which is to maintain a reduced temperature differential between the centerline of the casting surface and the side edges thereof, minimizing the portion of the heat which flows transversely.

Figure 6:
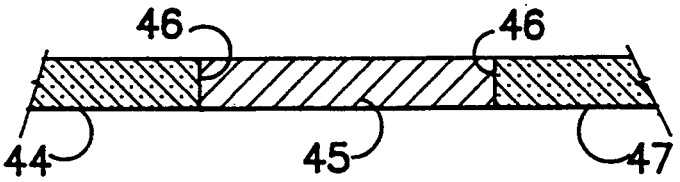
FIG. 6 is another alternative embodiment of the casting strip of FIG. 4.

FIG. 6 illustrates another embodiment wherein the casting surface 45 has each of its side edges 46 abutting one of two opposite ceramic inserts 44 and 47. Because the ceramic material has a lower heat flow rate than the metal of casting surface 45, relatively little heat can flow transversely of the casting surface. Most heat flows radially inwardly directly into the fluid within the drum. Thereby, the desired objective of relatively small temperature differentials transversely across the surface of the casting surface is achieved. It will be understood that plastic or other material might be substituted for the ceramic insert 44 or indeed the whole drum may be constructed of some material having a low heat conductivity characteristic while the casting strip remains of the high heat conductivity characteristic of metals. The width of ceramic inserts 44 is not important. A thin, annular washer of material having a low heat transfer characteristic is sufficient to retard transverse heat flow to the extent necessary to achieve the desired result of this invention.

Figure 7:
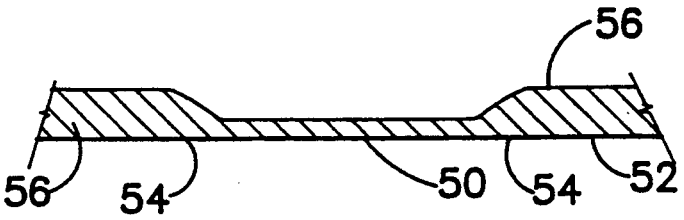
FIG. 7 is another alternative embodiment of the casting strip of FIG. 4.

FIG. 7 illustrates another embodiment wherein the casting surface 50 and the transverse drum surface 52 have essentially the same external radii, but the side edges 54 of the casting surface 50 are integral with a much greater thickness of the remainder of the metal drum 56.

In this embodiment the laterally transferred heat flow is substantially reduced with respect to the radial heat flow because the central portion of the casting surface 50 is thinner and consequently the length of the heat flow path to the coolant liquid is considerably reduced. As a result, heat flowing from the central portion of the casting surface 50 has a shorter and consequently lower resistance flow path to reach the coolant, while heat flowing from the edges of the casting surface 50 must flow further through the thicker metal and therefore flows through a higher resistance flow path.

Because heat flow tends to have an increasingly greater proportion of lateral flow component nearer the edges, it is preferred that the thickness or wall surface be curved so that it is increasingly thicker at the edges. This preferably provides an increasingly greater thermal resistance in proportion to and to compensate for the otherwise increasingly greater lateral component of heat flow at the edges.

Figure 8:
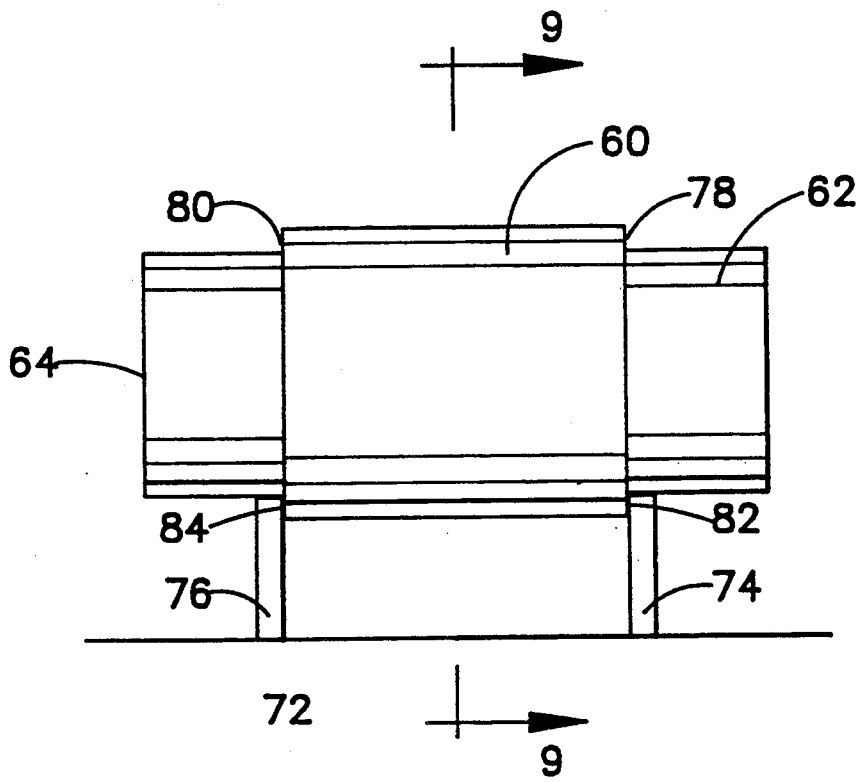
FIG. 8 is a top plan view illustrating the sealing structure improvement of the present invention.
Figure 9:
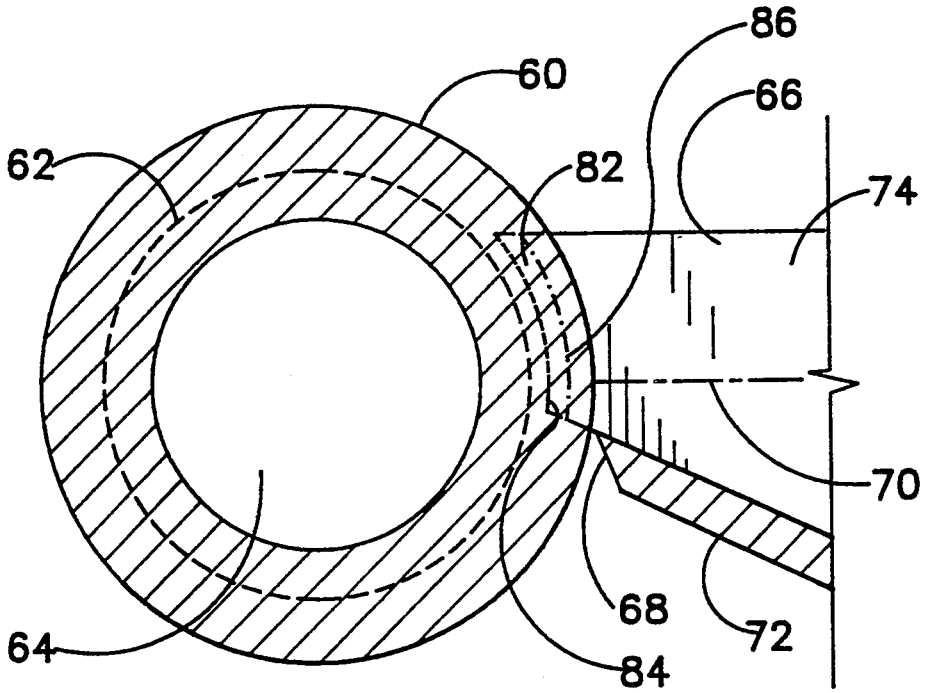
FIG. 9 is a view in section taken substantially along the line 9—9 of FIG. 8.

The use of a raised or projecting casting surface, of the type shown in FIG. 4, has been found to provide an additional advantage by achieving an improved seal between the edge over which the molten metal flows onto the drum and the drum itself. An embodiment of this feature is illustrated in FIGS. 8 and 9.

A raised casting surface 60 protrudes above the remaining peripheral surface 62 of the rotating drum 64. The nozzle or spout 66 of the receptacle containing molten metal has an edge 68 over which the molten metal overflows onto the casting surface 60. The top surface 70 of the molten metal is illustrated in phantom. The nozzle 66 includes a bottom wall 72 and two side walls 74 and 76.

In the melt overflow casting of metal strip or ribbon, a gap must exist between the casting surface 60 and the edge 68 so that there is no frictional contact, but the gap must not be so great that molten metal will fall through the gap. A similar gap must exist between the side walls 74 and 76 of the spout 66 and the surfaces of the rotating drum 64. Since the metal of the casting drum 64 expands at the beginning of the casting process because its temperature becomes considerably elevated, the casting process must be initiated with a significant gap so that the casting surface will not expand and contact the nozzle 66. Additionally, during casting, solidified metal or slag may collect on and protrude from the edge 68, necessitating some adjustment of the rotating drum away from the edge 68.

Conventionally, the side walls of the spout 66 are formed as a cylindrical segment, concentrically mating with the cylindrical surface of the drum 64 and spaced by a gap from it. However, if the rotating drum is adjusted away from the edge 68 to avoid contacting the edge, the gap between the conventional side walls and the peripheral surface of the drum 64 simply becomes larger and an opportunity for leakage is presented.

The use of the protruding casting surface 60 permits the inner surfaces of the spout side walls 74 and 76 to abut, in spaced relation, the annular end walls or shoulders 78 and 80 at the sides of the casting surface 60. These surfaces interface in the regions 82 and 84 and are aligned parallel to the direction of adjusting movement of the drum 64. As a result, motion of the drum 64 away from the edge 68 does not change the gap between the inner surface of side wall 74 of the spout 66 and the end wall shoulder surface 78, for example, of the casting surface 60.

Thus, for example, the forward end of the side walls, such as the side wall 74, may be positioned at the hidden line 84, illustrated in FIG. 9, but may be moved so that it is spaced further to the phantom line 86 without changing the spacing distance of the interfacing gaps at the locations 82 and 84.

While certain preferred embodiments of the present invention have been disclosed in detail, it is to be understood that various modifications may be adopted without departing from the spirit of the invention or scope of the following claims.

What is claimed is:

1. An apparatus for melt overflow casting of a metal sheet, the apparatus including a receptacle for containing a pool of molten metal, the receptacle having sidewalls, one of which has an upper, overflow edge over which molten metal flows against a rotatable, heat-conducting drum during rotation of the drum, for extracting heat from liquid metal in contact with the drum and forming the solidified sheet on the peripheral surface of the drum, the apparatus comprising:

(a) an outer cylindrical casting surface formed on the drum and defined by a pair of axially spaced, terminal, annular shoulders on laterally opposite sides of the casting surface and located inwardly from each end of the drum; and (b) a pair of spaced walls formed on the receptacle at opposite ends of the overflow edge and spaced apart by a distance substantially equal to the distance between said spaced terminal shoulders of the casting surface for confining the region of contact between the molten metal and the drum to said casting surface.

2. An apparatus in accordance with claim 1 wherein the casting surface is a raised annular boss projecting radially outwardly from the drum.

3. An apparatus in accordance with claim 1 wherein said shoulders are formed by a pair of spaced annular grooves formed into the peripheral surface of the drum.

4. An apparatus in accordance with claim 1 wherein the drum further includes a thermally insulative material outwardly and laterally adjacent said terminal shoulders.

5. An apparatus in accordance with claim 1 wherein the radial thickness of the drum at the casting surface is substantially constant.

* * * * *